US005427322A

United States Patent [19]

DesRosiers

[11] Patent Number: 5,427,322

[45] Date of Patent: Jun. 27, 1995

[54] DYE SPRING

[75] Inventor: Victor DesRosiers, Kinderhook, N.Y.

[73] Assignee: Crellin, Inc., Chatham, N.Y.

[21] Appl. No.: 962,132

[22] Filed: Oct. 16, 1992

[51] Int. Cl.[6] ..... B65H 75/20; D06F 17/00

[52] U.S. Cl. ..... 242/118.110; 68/198

[58] Field of Search ..... 242/118.1, 118.11; 68/198

[56] References Cited

U.S. PATENT DOCUMENTS

| | | | |
|---|---|---|---|
| 3,465,984 | 9/1969 | Tigges et al. | 242/118.11 |
| 4,181,274 | 1/1980 | Burchette, Jr. | 242/118.11 |
| 4,454,734 | 6/1984 | Marquis et al. | 242/118.11 X |
| 4,789,111 | 12/1988 | Thomas et al. | 242/118.1 |
| 4,823,565 | 4/1989 | Hahm | 242/118.1 X |
| 4,872,621 | 10/1989 | Thomas | 242/118.11 |
| 4,941,621 | 7/1990 | Pasini | 242/118.1 |
| 4,986,488 | 1/1991 | Windhösel et al. | 242/118.1 |
| 5,094,404 | 3/1992 | DesRosiers et al. | 242/118.11 |

*Primary Examiner*—Daniel P. Stodola
*Assistant Examiner*—Michael R. Mansen
*Attorney, Agent, or Firm*—Kane, Dalsimer, Sullivan, Kurucz, Levy, Eisele & Richard

[57] ABSTRACT

This invention is directed towards improvements in collapsible dye tubes, commonly referred to as dye springs. The dye springs of the present invention are characterized in that they are resiliently compressible and are further able to withstand elongation. The dye spring has a surface area of cylindrical shape with elements disposed between rings at the end of the tube. The elements insure that the dye spring surface area remains open when the dye spring is in a compressed state so that dye will be able to flow radially outwardly through the tube and thereby dye the yarn wound around the tube. The elements further insure that the degree of elongation experienced by the spring during winding operations is substantially diminished or even eliminated.

18 Claims, 5 Drawing Sheets

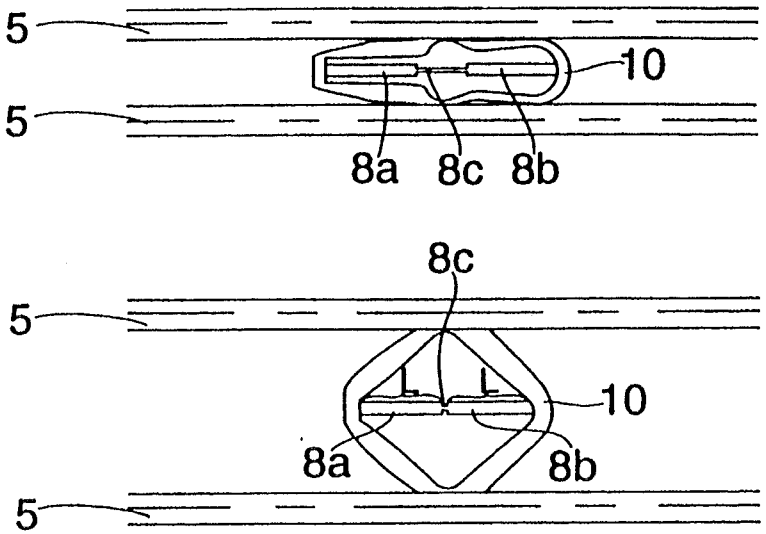
FIG. 2b
FIG. 2a
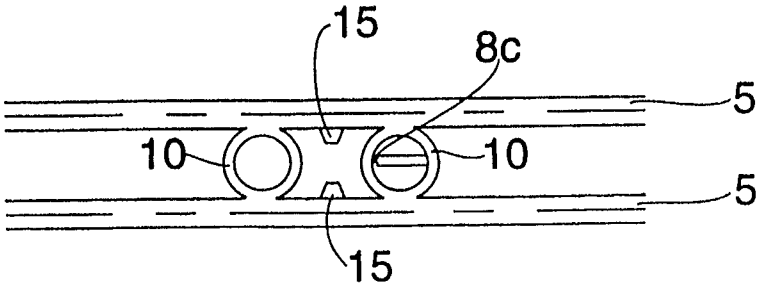
FIG. 1e
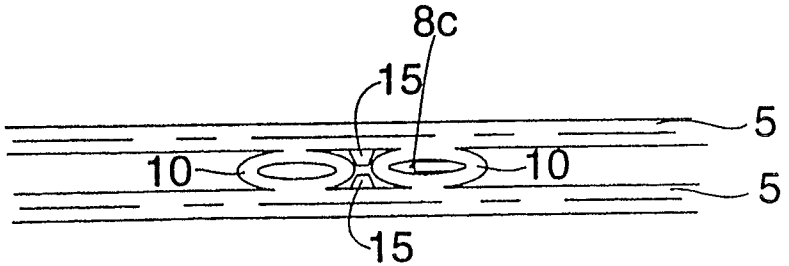
FIG. 1f

DYE SPRING

BACKGROUND OF THE INVENTION

This invention is directed towards improvements in collapsible dye tubes, commonly referred to as dye springs. The dye springs of the present invention are characterized in that they are resiliently compressible and are further able to withstand elongation. The dye spring has a surface area of cylindrical shape with elements disposed between rings at the end of the tube. The elements insure that the dye spring surface area remains open when the dye spring is in a compressed state so that dye will be able to flow radially outwardly through the tube and thereby dye the yarn wound around the tube. The elements further insure that the degree of elongation and/or compression experienced by the spring during winding operations is substantially diminished or even eliminated.

THE PRIOR ART

Generally, dye springs are made of a molded thermoplastic material that is collapsible and are disposable after a single use. The dye tube is wound with yarn and the yarn dyed. The yarn thereafter is wound off the tube and the tube is discarded. The dye tube of prior art U.S. Pat. No. 4,181,274 comprises a pair of annular flanges and an intermediate structure between the flanges comprising at least one member extending generally axially to the length of the tube and a plurality of rigid members, such as rings or helices, that extend generally transversely to the length of the tube. The members are integrally formed by molding to initially define a rigid structure having an open network with at least some of these rigidly extending members being deformable by an axial force to cause axial compression of the tube. These members are referred to as ribs which form an open network to permit passage of dye therethrough.

Prior art U.S. Pat. No. 3,465,984 discloses a carrier resiliently compressible in the axial direction which comprises end rings and at least one intermediate ring with a plurality of ribs disposed between the end rings. These ribs are elastically bendable and equally distributed along the periphery of the carrier and inclined for at least a part of their length to the longitudinal axis of the carrier. The outer edges of the ribs are oriented toward the surface of the carrier, the ribs being rigidly secured to the rings.

The prior art attempts to insure that the cylindrical surface of the dye spring remains sufficiently open after compression have not been entirely successful. Frequently the members deform so that the surface of the dye tubes become closed, effectively limiting, if not prohibiting, dye flow. Furthermore, the prior art does not adequately address the phenomenon of spring elongation and/or compression, which is caused by the torsional forces applied to the spring during winding operations. Elongation is highly adverse because it causes the springs to buckle and possibly jump out of the winding machines or prevent machines from automatically doffing. Compression usually causes the spring to jump out of the machine.

SUMMARY OF THE INVENTION

It is an object of the invention to provide an improved dye spring which is open on at least part of its surface when it is compressed.

It is a further object of the invention to provide an improved dye spring which resists and withstands elongation and/or compression during the winding operation.

Other objects shall become apparent from the following disclosure.

The present invention is directed towards a dye spring that is resiliently compressible in the axial direction and is able to prohibit or prevent elongation and/or compression in the axial direction. The dye spring generally has a surface area of cylindrical shape with elements disposed between rings at the end of the tube. The elements are generally comprised of at least one ring member, and a plurality of spaced, rigid stays that are integrally formed with the rings and define therewith an initially rigid network for winding yarn which is to be dyed. The elements are generally comprised of a structure of outer members and inner members appearing upon and integral with the outer members. The outer members are integral with the rings and define an area in the spaces between the rings. The inner members are integral with the outer members and lie in the circumferential plane formed by the rings of dye spring. The network of outer members and inner members cooperate to insure that a portion of the circumferential surface of the dye spring remains open upon compression of the tube so that dye can flow radially outwardly through the open spacing. Also provided are axial spacing stops that are integral with the rings and formed in pairs. Each member of the pair sits adjacent to the other member of the pair with the pairs being aligned so that each pair is substantially parallel along an axis formed along the length of the tube. The network of outer and inner members further cooperate to substantially diminish or prevent the dye spring from elongating and/or compressing.

BRIEF DESCRIPTION OF THE DRAWINGS

FIG. 1*e* is a partial side elevational view of a third embodiment of the invention.

FIG. 1*f* is a partial side elevational view of the third embodiment of the invention in a compressed state.

FIG. 2*a* is a partial side elevational view of a fourth embodiment of the present invention.

FIG. 2*b* is a partial side elevational view of the embodiment of FIG. 2*a* shown in a compressed state.

DETAILED DESCRIPTION OF THE PREFERRED EMBODIMENT

The figures depict a dye spring constructed in accordance with the principles of the present invention. The dye spring structure and dye spring itself is shown in FIGS. 1*a*, 2*a*, 3 and 5. End rings 25 define the outer edge of the tube, with the rings 5 being spaced intermediate the end rings 25. Rings 5 and end rings 25 define a cylindrical surface area along the longitudinal axis of the spring, with the length of that axis itself L30 defined by the spacing of the rings 5 and end rings 25, and the number of rings 5.

Figure 1C:
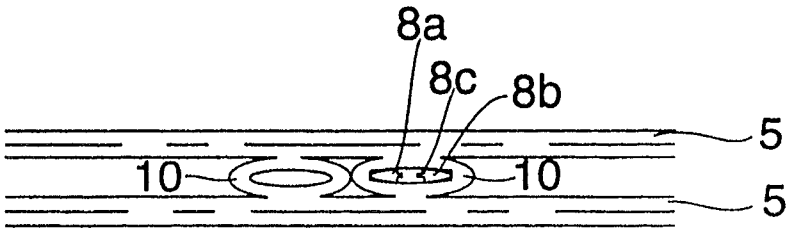
FIG. 1*c* is partial side elevational view of a second embodiment of the present invention in a compressed state.
Figure 1D:
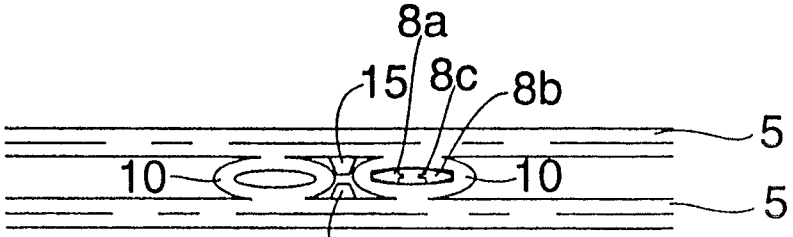
FIG. 1*d* is a partial side elevational view of an alternative to the first embodiment shown in FIG. 1*b*.
Figure 1A:
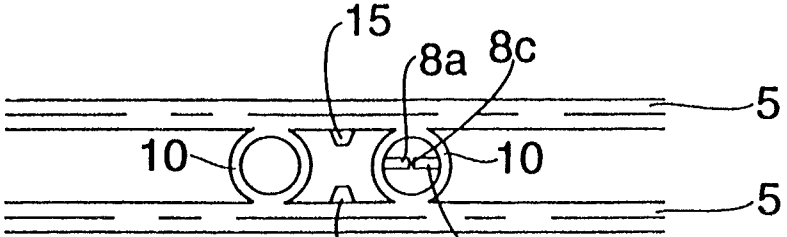
FIG. 1*a* is a partial side elevational view of a first embodiment of the present invention.
Figure 3:
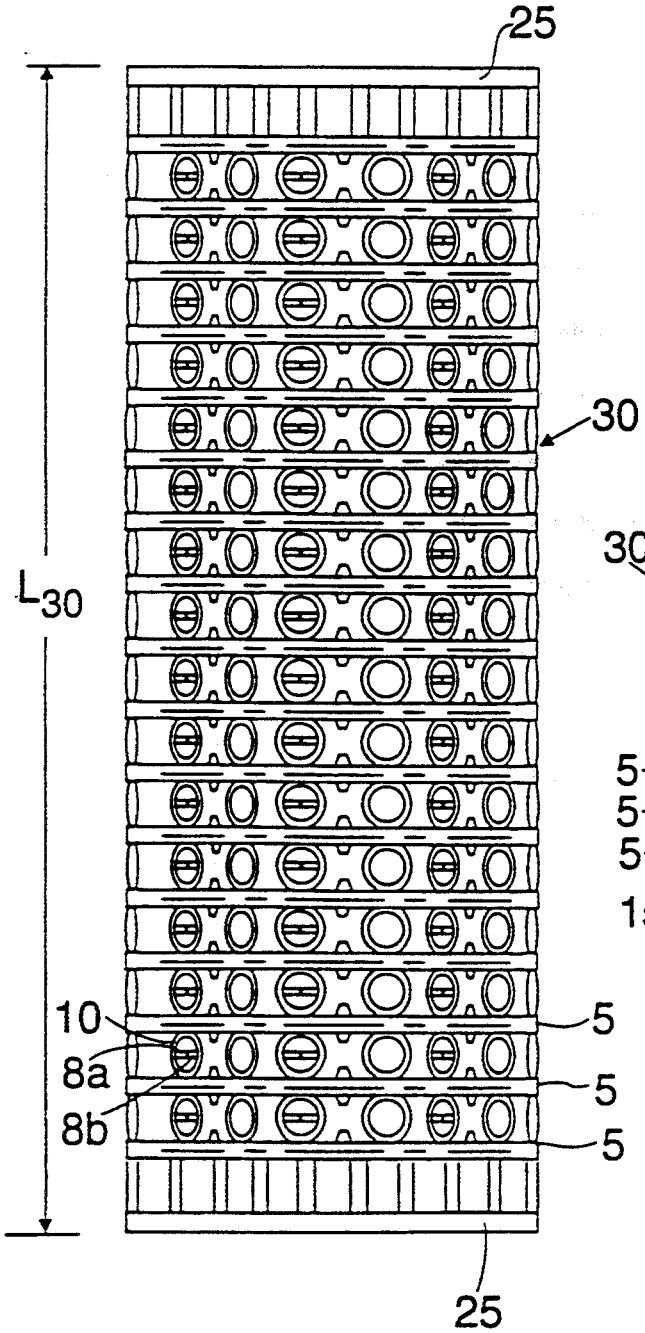
FIG. 3 is a partial side elevational view of a dye spring incorporating the first embodiment of the present invention.
Figure 5:
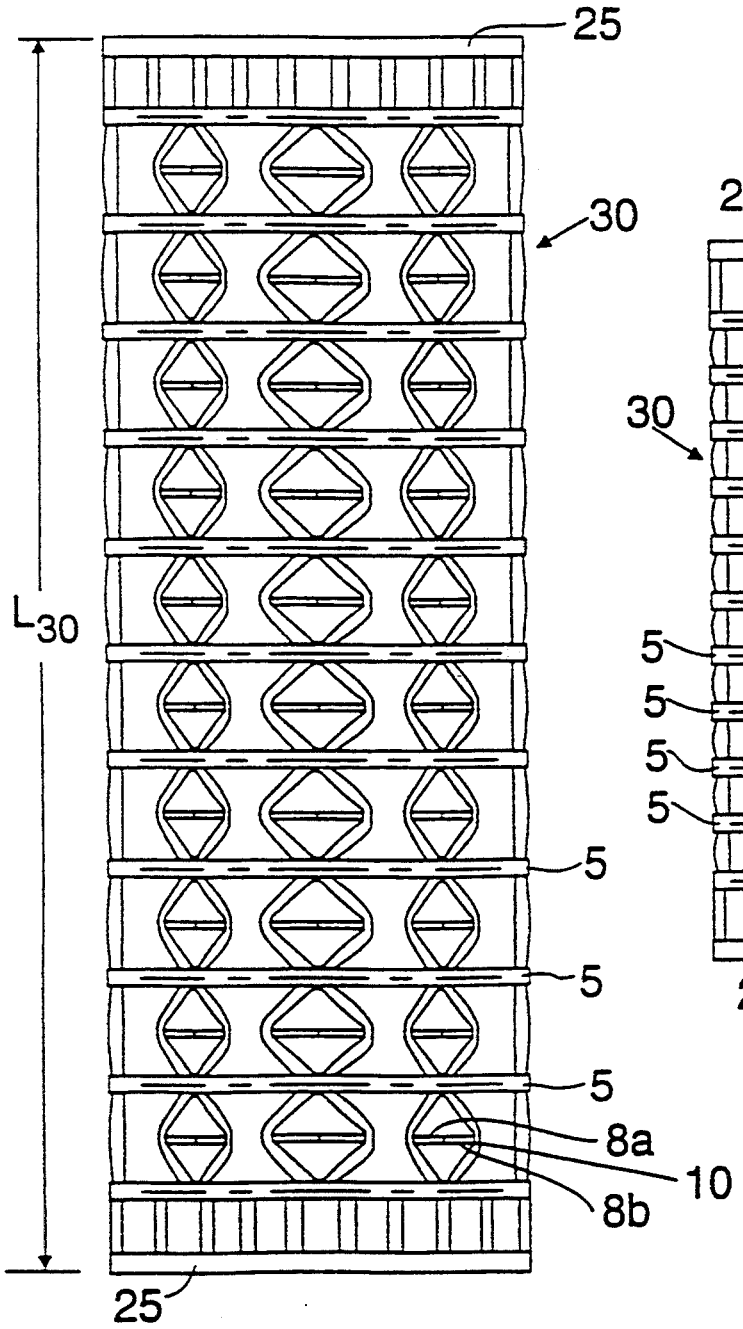
FIG. 5 is a partial side elevational view of a dye spring incorporating the fourth embodiment of the present invention.
Figure 6:
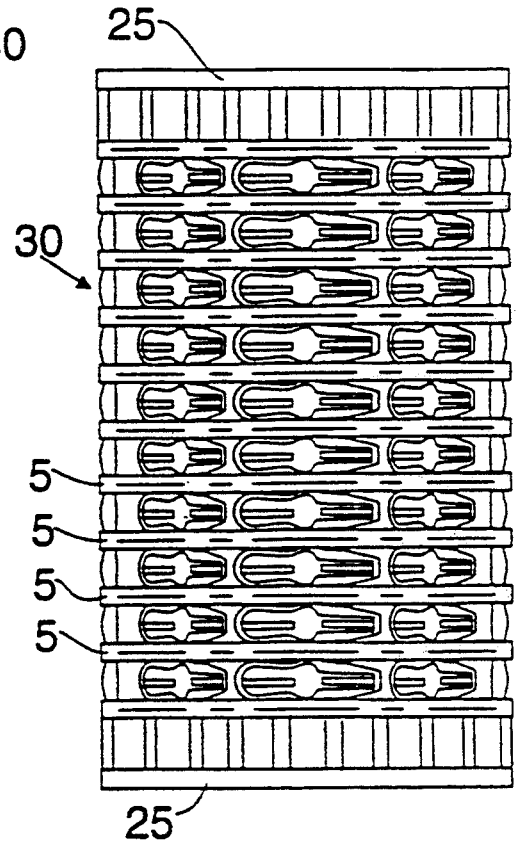
FIG. 6 is a partial side elevational view of the dye spring of FIG. 5 in the compressed state.
Figure 9:
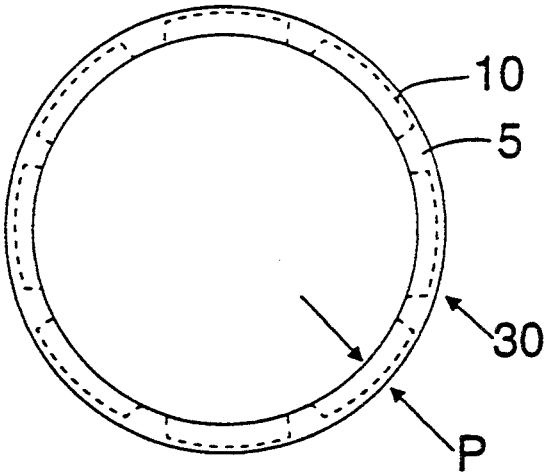
FIG. 9 is a top perspective view of the dye spring.

Outer members 10 are integrally formed with rings 5 and 25 and in combination with rings 5 and 25 define a cylindrical open surface area along the spring. Outer members 10 may be circular in shape, as is shown in FIG. 1*a* and 3, or it may have the shape of a square, rectangle, or other parallelogram as shown in FIGS. 2*a* and 5. Inner members 8*a*, 8*b* are integrally formed upon the outer members 10. Outer member 10, as well as inner members 8*a*, 8*b* lie in the circumferential plane P formed within the circumferential surface area of the dye spring. See FIG. 9. Inner members 8*a*, 8*b* have a length dimension L (see FIG. 2*a*) so that they nearly abut each other when the spring is in the uncollapsed and unelongated state. Inner members 8*a* and 8*b* are connected by bridge 8*c* which is integral with inner members 8*a* and 8*b*. Bridge 8*c* is relatively thinner than members 8*a* and 8*b* and will elongate upon compression of the dye spring. See FIG. 1*b*. Alternatively, bridge 8*c* can be designed to fracture upon compression. See FIGS. 1*c*, 1*d*. Under either alternative, bridge 8*c* provides resistance which inhibits the occurrence of total dye spring collapse.

The rings can be additionally provided with axial spacing stops 15 integral with the rings 5, which extend into the space between the rings, grouped together in pairs parallel to the longitudinal axis of the tube. Axial spacing stops 15 are dimensioned so that upon compression of the tube the pairs of stops will not abut each other so that yarn pinching, an adverse condition, will be avoided. The dye springs of the present invention are designed so as to collapse axially when a predetermined force is applied to the tube. The predetermined force will generally be an amount required to collapse the dye spring after the winding the yarn upon the tube.

When the dye spring is collapsed, the network of outer members and inner members function to insure that a portion of the cylindrical surface area of the dye spring remains open during and after collapse of the dye spring so that dye can flow through the spaces in the cylindrical area upon the dye spring and contact the yarn wound upon the spring. The dye spring is shown in a collapsed position in FIGS. 1*b*, 1*c*, 1*d*, 1*f*, 2*b*, 4 and 6.

Figure 1B:
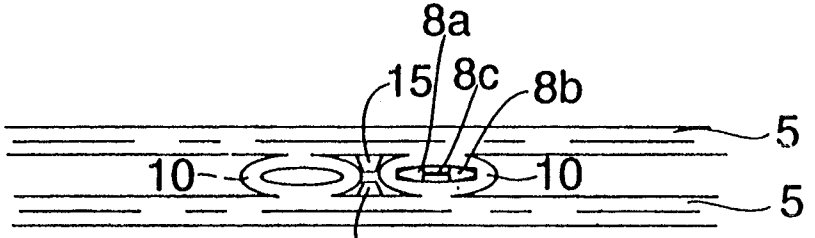
FIG. 1*b* is a partial side elevational view of the embodiment of FIG. 1*a* shown in a compressed state.
Figure 4:
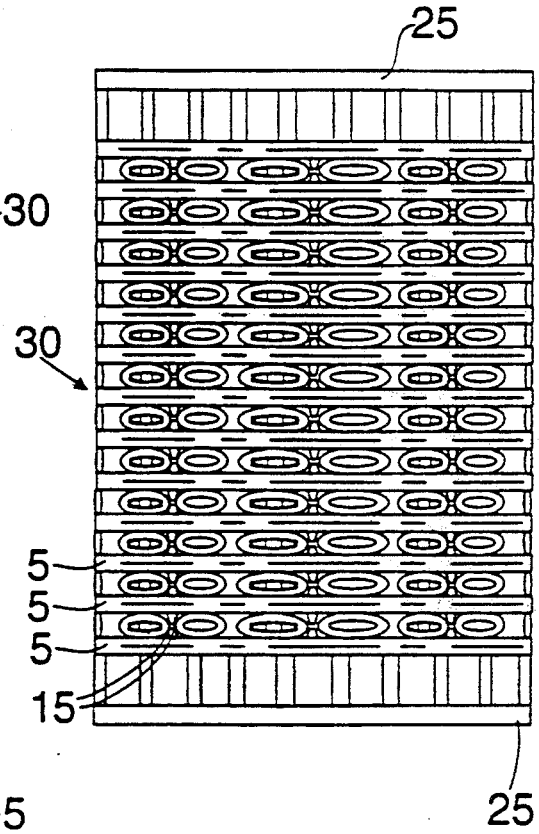
FIG. 4 is a partial side elevational view of the dye spring of FIG. 3 in the compressed state.
Figure 8:
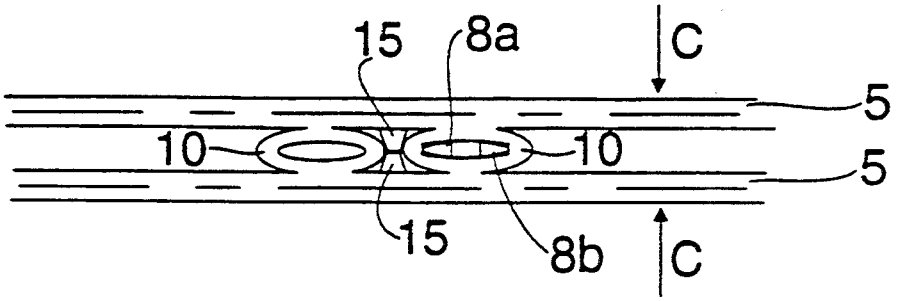
FIG. 8 is a partial side elevational view of a section of the dye spring under a compressional load.

During collapse, the dye spring becomes compressed, forcing the rings closer together, compressing the outer members 10 so that they become elongated in shape. As shown in FIGS. 1*b*, 4, and 8, the circular outer members become elongated and take on an oval shape. A similar effect can be observed for the parallelogram shaped outer members in FIGS. 2*b* and 6. The inner members 8*a*, 8*b*, which are integral with the outer members 10, move outwardly and away from each other thus stretching or fracturing the bridge 8*c* as shown in FIGS. 1*b* and 8 when a compression force C is applied to the dye spring. Referring to FIGS. 1*b* and 2*b*, the movement of the inner members 8*a*, 8*b* due to the elongation of the outer members 10 stretches bridge 8*c*. Bridge 8*c* may also fracture due to the elongating effect. In any event, the stretching of bridge 8*c* resists the compressive forces that may develop during winding. The combination of adjacent outer members or outer member and adjacent stops prevent the total collapse of the dye spring which would effectively prohibit or reduce the flow of dye radially outwardly through the tube.

An additional manner of preventing total collapse is to space adjacent outer members so that upon collapse, the elongated outer members will abut each other and thereby provide an additional source of resistance to total collapse. See FIG. 1*c*. This embodiment can be provided for by omitting axial spacing stops 15.

Figure 7:
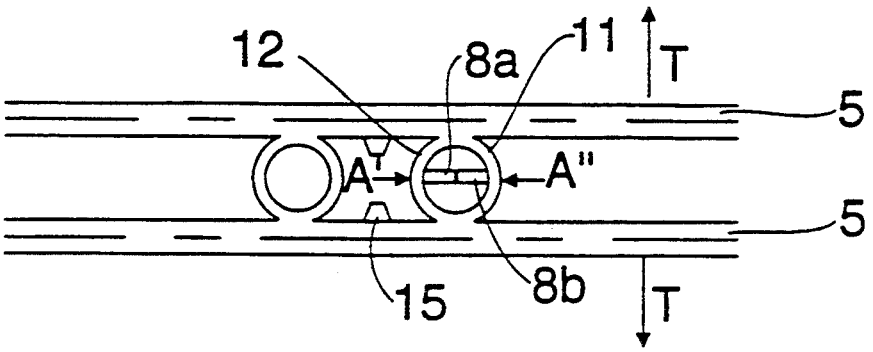
FIG. 7 is a partial side elevational view of a section of the dye spring under a tensile load.

The inner and outer members also prevent or at least substantially diminish the degree of elongation experienced by the dye spring during the winding operation. Elongation is the result of torsional forces exerted on the spring during the winding operation and could result in buckling of the dye spring or cause the dye spring to jump out of the winding mandrel. As illustrated in FIG. 7 tensile forces are exerted upon the dye spring 30, urging the dye spring to elongate as designated by arrows T. As a result of this urging the opposite sides of the outer members 11, 12 will tend to move closer together as shown by the arrows A and A". Because the inner members 8*a*, 8*b* are joined by bridge 8*c* and are dimensioned to abut each other upon elongation of the spring, the abutting action of the inner members 8*a*, 8*b* and compression of bridge 8*c* will further prohibit the outer members from moving closer together, stabilizing the spring against further elongation. It should be apparent to a person skilled in the art that while it is not necessary for the inner members to abut each other, they should be of a sufficient length so that they will be caused to abut during the application of a torsional force and prohibit an undesired degree of elongation.

An alternative embodiment is shown in FIG. 1*e*, wherein only one inner member is provided with a bridge 8*c*. This embodiment would also function to prevent compression and elongation in the manner set forth for the embodiment having inner members 8*a* and 8*b*. FIG. 1*f* shows this embodiment in a compressed state, where bridge 8*c* has been fractured.

The dye springs of the present invention are preferably integral and injection molded from polypropylene and similar thermoplastic resins and modifications thereof. The material used should be able to withstand the elevated temperatures of dye baths and should provide sufficient structural integrity to endure the various forces described above and other forces apparent to the skilled artisan.

I claim:

1. A dye spring comprised of a pair of end rings;

at least one intermediate ring, said at least one intermediate ring being concentrically arranged relative to said end rings;

outer members disposed between the end rings and defining with said end rings and said at least one intermediate ring a cylindrical surface area about the dye spring, said outer members being grouped in a circumferential plane within the cylindrical surface area, said outer members being integral with said end rings and said at least one intermediate ring, each of said outer members individually defining an enclosed area within the outer members, a plurality of inner members wherein each inner member is integral with a single outer member, each inner member being disposed within the enclosed area individually defined by at least one of the outer members, said outer members and each inner member being substantially arranged within the circumferential plane about the dye spring.

2. The dye spring as set forth in claim 1 wherein the dye spring is further comprised of axial spacing members integral with said end rings and said at least one intermediate ring.

3. The dye spring as set forth in claim 2 wherein the axial spacing members are grouped in pairs which are aligned substantially parallel to a longitudinal axis of said dye spring.

4. The dye spring as set forth in claim 1 further comprised of first and second inner members grouped in pairs, the first and second inner members of the pairs having a length dimension that is substantially transverse to the longitudinal axis of the dye spring, the length dimension of the first and second inner members being sufficient to insure that a compressional force will be applied to the first and second inner members when the dye spring is subjected to torsional forces.

5. The dye spring as set forth in claim 4 further comprised of a bridge for each pair of first and second inner members, the bridge adjoining and being integral with the first and second inner members and positioned intermediate the first and second inner members.

6. The dye spring as set forth in claim 4 wherein the first and second inner members abut when the dye spring is in an uncollapsed or unelongated state.

7. The dye spring as set forth in claim 4 wherein the first and second inner members are adjacent when the dye spring is in an uncollapsed or unelongated state.

8. The dye spring as set forth in claim 7 wherein the outer members are in the shape of a parallelogram.

9. The dye spring as set forth in claim 1 further comprised of an inner member for each of the outer members, the inner member having a first and second end, the inner member being integral at the first end with the outer member and integral at the second end with a bridge that is integral with the outer member.

10. The dye spring as set forth in claim 1 wherein the outer members are substantially circular in shape.

11. A dye spring comprised of a pair of end rings;

at least one intermediate ring, said at least one intermediate ring being concentrically arranged relative to said end rings;

elements disposed between the end rings and defining with said end rings and said at least one intermediate ring a cylindrical surface area about the dye spring, said elements being grouped in a circumferential plane within the cylindrical surface area, said elements being comprised of first members and second members, the first members being integral with said end rings and said at least one intermediate ring and each of the first members individually defining an enclosed area within the first members, the second members being integral with the first members, said second members being disposed within the enclosed area individually defined by the first members, there being at least one second member for each of said first members, said first and second members being substantially arranged within the circumferential plane within the cylindrical surface area of the dye spring, and said second members having a length dimension that is substantially transverse to the longitudinal axis of said dye spring, the second members being integral with a bridge, the bridge being disposed within the area defined by the first members and having a thickness that is lesser than a thickness of the second members.

12. The dye spring as set forth in claim 11 wherein the dye spring is further comprised of axial spacing members integral with said end rings and said at least one intermediate ring.

13. The dye spring as set forth in claim 11 wherein the axial spacing members are grouped in pairs, the pairs of said axial spacing members being aligned substantially parallel to the longitudinal axis of said dye spring.

14. The dye spring as set forth in claim 11 wherein a pair of second members are integral with the first members and the bridge is positioned intermediate the second members and is integral with the second members.

15. The dye spring as set forth in claim 11 wherein integral with each of the first members, the second members being integral at a first end with the first members and integral at a second end with the bridge.

16. The dye spring as set forth in claim 11 wherein the first members are substantially circular in shape.

17. The dye spring as set forth in claim 11 wherein the first members are in the shape of a parallelogram.

18. A dye spring comprised of a pair of end rings;

at least one intermediate ring, said at least one intermediate ring being concentrically arranged relative to said end rings;

a plurality of elements disposed between the end rings and defining with said end rings and said at least one intermediate ring a cylindrical surface area about the dye spring, said elements being grouped in a circumferential plane within the cylindrical surface area, said elements being comprised of outer members being integral with said end rings and said at least one intermediate ring, each of the outer members individually defining an enclosed area within the outer members, inner members integral with the outer members, said inner members being disposed within the enclosed area individually defined by the outer members, said outer members and inner members being substantially arranged within the circumferential plane about the dye spring with said outer members being further arranged within the circumferential plane about the dye spring so that when the dye spring is compressed the outer members will deform and be caused to abut adjacent outer members.

* * * * *